United States Patent [19]

Koenig et al.

[11] 3,984,236

[45] Oct. 5, 1976

[54] FLUX POWDER FOR USE DURING CONTINUOUS CASTING OF STEEL

[75] Inventors: Peter J. Koenig, Zumikon; Friedrich Hofmanner, Regensdorf, both of Switzerland

[73] Assignees: Concast AG, Zurich; Holderbank Financiere AG, Glarus, both of Switzerland

[22] Filed: Jan. 20, 1975

[21] Appl. No.: 542,206

[30] Foreign Application Priority Data

Jan. 29, 1974 Switzerland ..... 1155/74

[52] U.S. Cl. ..... 75/94; 75/53; 75/57; 75/58

[51] Int. Cl.[2] ..... C22B 9/10; C21C 7/00

[58] Field of Search ..... 75/3–5, 75/94, 53, 57, 58

[56] References Cited

UNITED STATES PATENTS 3,156,557 11/1964 Dahl ..... 75/4

3,446,614 5/1969 Johnson ..... 75/53

*Primary Examiner*—Peter D. Rosenberg

*Attorney, Agent, or Firm*—Werner W. Kleeman

[57] ABSTRACT

A flux powder for use during the continuous casting of steel, containing Portland cement, a fluxing agent and a carbon carrier. The carbon carrier possesses a grain size of less than 1 $\mu$, the powder having an aluminum oxide content in the range between 2 – 12 percent by weight, and a lime-silica ratio adjusted between 0.7 and 1.0 through the addition of quartz powder. The carbon carrier is carbon black containing carbon in an amount of 2 – 8 percent by weight, and wherein the carbon black is present as powder carbon black. The powder carbon black can be in the form of lamp black.

2 Claims, No Drawings

FLUX POWDER FOR USE DURING CONTINUOUS CASTING OF STEEL

BACKGROUND OF THE INVENTION

The present invention relates to a flux powder for use in the continuous casting of steel, containing Portland cement, a fluxing agent and a carbon carrier.

It is already known to the art, for instance from our commonly assigned U.S. Pat. No. 3,788,840 granted Jan. 29, 1974, the disclosure of which is incorporated therein by reference that with such type flux powder the carbon carrier possesses a grain size beneath 1 $\mu$, the aluminum oxide content of the powder is in a range between 2 and 12 percent by weight, and the lime-silica ratio is adjusted between 0.7 and 1.0 through the addition of quartz powder and that the carbon is present in the form of carbon black in an amount of 2 to 8 percent by weight.

It has however been found that not all types of carbon black have the same behavior in the mold. Thus when using certain carbon blacks there occurs a pronounced formation of flames and dust as well as spraying of sparks. This is quite disturbing for the operating personnel present at the continuous casting mold. For the caster what is particularly disturbing is the emitting of the sparks because apart from hindering the view such also is tiring to the eyes.

SUMMARY OF THE INVENTION

It is therefore a primary object of the present invention to maintain as small as possible the formation of dust and flames as well as the emission of sparks by selecting a suitable carbon black as the carbon carrier.

Now according to the invention this objective can be realized in that the carbon black is present in the form of pulverulent carbon black in the flux powder.

DETAILED DESCRIPTION OF THE INVENTION

When using a powder or pulverulent carbon black in the flux powder there occurs a considerably lesser development of dust in contrast to dispersed pearl carbon black, and such favors the faultless visual access of the bath level in the mold. When casting a format of 1,700 × 250 millimeters with 0.3 kg powder per ton of steel there occurs, for instance a 20-fold lesser emission of dust than under the same conditions with another powder containing the dispersed pearl carbon black, that is to say, a carbon black which has been subjected to the formation of pearls or beads for the purpose of facilitating the transport and conveyability and for preventing the conglomeration of the carbon black particles. Due to the formation of the pearls or beads and subsequent grinding to the desired granulation size there apparently occurs a disadvantageous change in the surface properties of the carbon black particles.

In contrast to a flux powder with dispersed pearl or bead carbon black it was possible to prevent with the use of powder or pulverulent carbon black in the flux powder a flame formation at the powder surface accompanied by intensive spark emission.

It is advantageous if the powder carbon black is present in the flux powder in the fine and unchanged manner after its production by incomplete combustion or thermal dissociation of the raw material. In this form it is difficult to oxidize, which in turn favorably influences the flame formation and the spark emission. By means of incomplete combustion the carbon black normally can be obtained from petroleum- and coal tar oil-products, whereas for its fabrication by thermal dissociation the raw materials are natural gas, acetylene or low molecular hydrocarbons.

What has been found to be particularly favorable is the use of lamp black as one form of the powder carbon black, which in unchanged form is admixed to the flux powder after its having been obtained from petroleum- and coal tar oil-products.

While there is shown and described present preferred embodiments of the invention, it is to be distinctly understood that the invention is not limited thereto but may be otherwise variously embodied and practiced within the scope of the following claims. Accordingly,

What is claimed is:

1. A flux powder for use in the continuous casting of steel, comprising Portland cement, a fluxing agent, aluminum oxide, lime-silica and a carbon carrier, the aluminum oxide possessing a content in the range of between 2 to 12 percent by weight, and the ratio of lime-silica being adjusted between 0.7 and 1.0 through the addition of quartz powder, the carbon being present in the form of carbon black in a quantity of 2 – 8 percent by weight, the improvement comprising: the carbon black is powder carbon black possessing a grain size of less than 1 $\mu$.

2. The flux powder as defined in claim 1, wherein the powder carbon black is present in the form of lamp black.

* * * * *